United States Patent [19]

Bergstrand

[11] 4,453,455

[45] Jun. 12, 1984

[54] FORCE AMPLIFYING DISPLACEMENT DEVICE

[76] Inventor: Gunnar Bergstrand, Norrskogsvägen 128, 145 72 Norsborg, Sweden

[21] Appl. No.: 385,642

[22] PCT Filed: Sep. 14, 1981

[86] PCT No.: PCT/SE81/00261

§ 371 Date: May 17, 1982

§ 102(e) Date: May 17, 1982

[87] PCT Pub. No.: WO82/00973

PCT Pub. Date: Apr. 1, 1982

[30] Foreign Application Priority Data

Sep. 19, 1980 [SE] Sweden ..... 8006601

[51] Int. Cl.[3] ..... F01B 15/02

[52] U.S. Cl. ..... 92/117 A; 92/140; 74/520

[58] Field of Search ..... 92/117 A, 117 R, 140; 91/217; 74/106, 520

[56] References Cited

U.S. PATENT DOCUMENTS

| | | | |
|---|---|---|---|
| 371,049 | 10/1887 | Fitts | 92/117 A |
| 3,732,784 | 5/1973 | Vogelei et al. | 92/117 R |
| 4,133,260 | 1/1979 | Gundal | 74/520 |

FOREIGN PATENT DOCUMENTS

| | | | |
|---|---|---|---|
| 955 | of 1858 | United Kingdom | 91/217 |

*Primary Examiner*—Paul E. Maslousky

[57] ABSTRACT

A force amplifying displacement device for displacement of an object (5) a predetermined distance relative to a frame (2) or the like, wherein a first, longer part of the displacement movement requires a relatively minor force, while a second, shorter part of the movement requires a substantially greater force. The device comprises a lever mechanism (13) active between the frame (2) and a power transmission rod (17). An operating unit (9), e.g. consisting of a pressurized fluid cylinder (10), piston (11) and piston rod (12), first operates directly between the object (5) and the frame (2,22) and, thereafter, by sensing the end portion (28) of the power transmission rod (7), by way of the lever mechanism (13), so that a strongly amplified force is applied to the power transmission rod (7) and the object (5).

8 Claims, 4 Drawing Figures

FORCE AMPLIFYING DISPLACEMENT DEVICE

The invention relates to a force amplifying displacement device.

More particularly, the invention concerns a displacement device, where a major part of the displacement movement requires only a minor force or no force at all (transportation movement), while a short part of the movement requires a substantially greater force. Example of such devices are machine tools, where a press head, a piercing tool, a deep-drawing tool or some other member is to be moved back and forth towards an opposite tool half, a die or the like. Here the major part of the movement hardly needs any force at all, while a substantial material deforming work is effected along a short distance and therefore entails the application of a very great force.

In order to generate such great forces, operating units such as pneumatic or hydraulic operating cylinders are often used, which are dimensioned for a specific stroke (the entire displacement distance) and a maximum force. This, however, involves a considerable overdimensioning, since the capacity of the operating unit is used only for a very short part of the operating stroke.

The object of the invention is thus to achieve such a displacement device that a smaller operating unit can be used owing to force amplification along a part of the displacement movement.

According to the invention this object is achieved by means of a special lever mechanism and its connection to the rest of the device.

The most important advantage gained from the invention is that substantially smaller units can be used, making the device cheaper and lighter than previously knwon structures.

The invention is described further below with reference to the appended drawings illustrating an embodiment.

Figure 1:
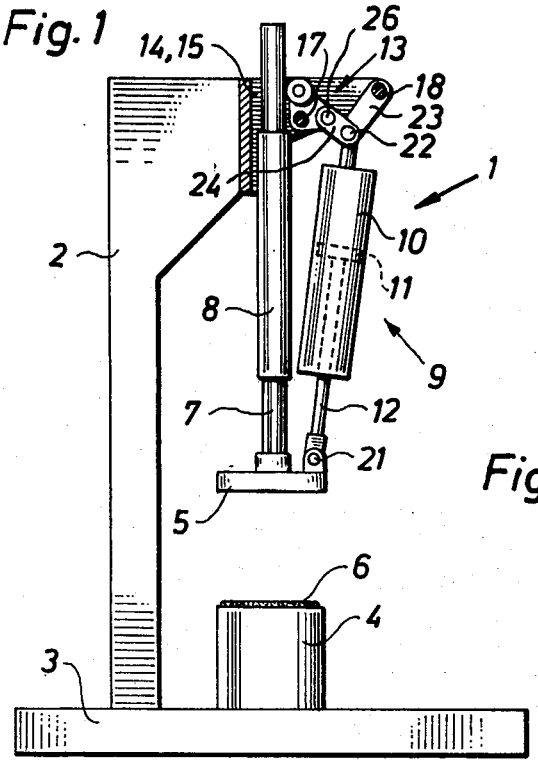
FIG. 1 shows schematically in side elevation a machine frame and a displacement device according to the invention.

The displacement device 1 shown in FIG. 1 is mounted on a machine frame 2 above an operating table 3. In the present example, the device is used for a sealed closure of a container 4 by means of a lid 5 carried by the displacement device, wherein the sealing is achieved by means of a sealing ring 6 of an elastomer material (compare also FIG. 4). Only along a very short part of the closing movement, a great force needs to be applied, i.e. when an acceptable sealing function is to be achieved by deformation of the sealing ring 6, so that a tight all-round contact is secured. Such a closing operation can be used e.g. for testing the tightness of the container, which is supplied with vaccuum or overpressure during a predetermined time period via a hose connection (not shown).

For the stated purpose - to accomplish a relatively long displacement movement with an insignificant force and a relatively short displacement movement with a great force - the device 1 comprises a power transmission rod 7 being linearly guided in a vertical tube portion 8 fixed to the machine frame, an operating unit 9 consisting of a pneumatic cylinder 10, a piston 11 displaceable therein, a protruding piston rod 12 and non-illustrated connection hoses for the pneumatic operation of the unit 9, as well as a force amplifying, conditionally operating lever mechanism 13.

Figure 2:
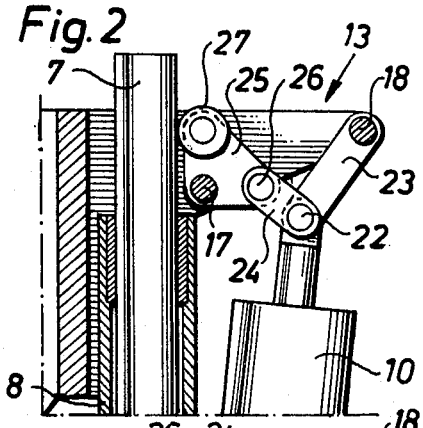
FIG. 2 shows, in a larger scale, the upper portion of the device according to FIG. 1 during a first part of the displacement movement.
Figure 4:
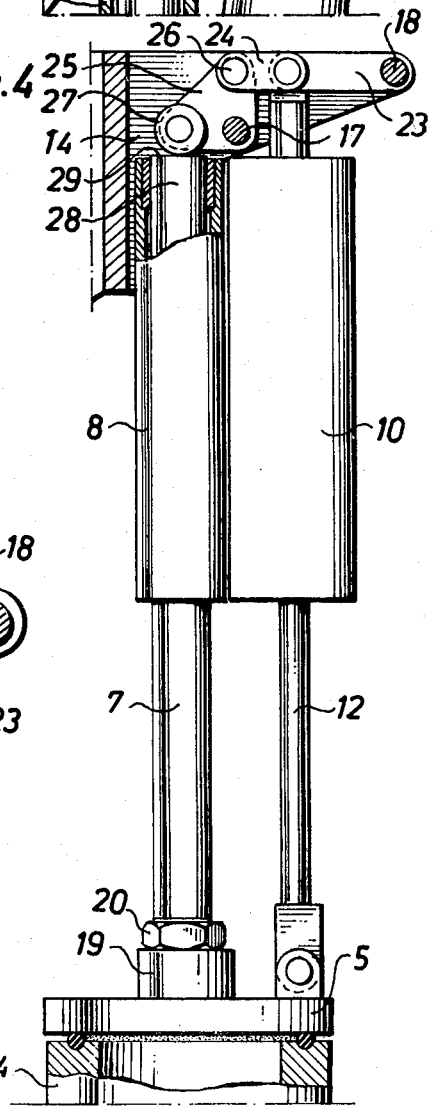
FIG. 4 shows, also in a larger scale, the displacement device in its entirety in a self-locking end position.
Figure 3:
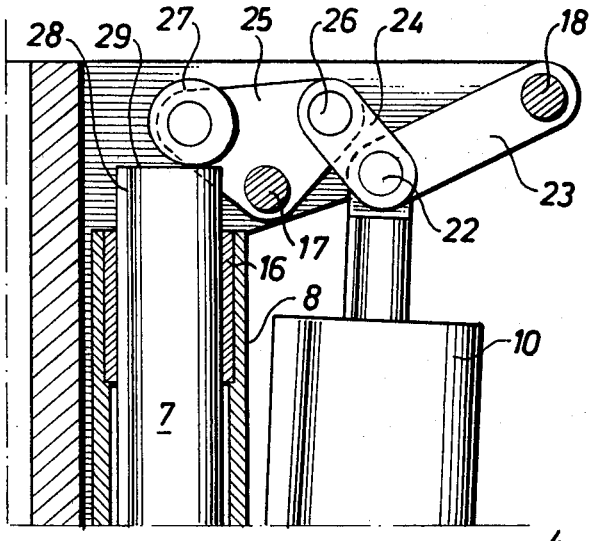
FIG. 3 shows, likewise in a larger scale, the upper portion of the device according to FIG. 1 during the final stage of the displacement movement.

The tube portion 8 is welded between two bracket plates 14, 15 (of which only one is visible in the side views in the figures) and is at the top and the bottom provided with internal slide bearings 16 (the upper one is shown in FIGS. 2, 3 and 4). Furthermore, between the bracket plates two stationary axes 17 and 18, respectively, included in the lever mechanism 13, are secured.

The power transmission rod 7, thus, is linearly guided in the slide bearings of the tube portion 8 and can be displaced upwardly-downwardly. The lower portion of the rod 7 is threaded, and the lid 5 is axially adjustable on the rod end by means of an internally threaded flange 19 and a lock nut 20 (see FIG. 4).

The lid 5 is also connected to the operating unit 9 by the lower portion of the piston rod 12 being pivotally secured to a pivot pin 21 disposed on the top side of the lid. From the lid 5, the operating unit 9, i.e. the piston rod 12 and the pneumatic cylinder 10, extend upwardly almost parallelly outside the rod 7 and the tube portion 8, and the upper cylinder end wall, by means of an attachment eye, is coupled to the lever mechanism 13 at the joint 22 between two links 23 and 24.

The lever mechanism 13, which appears best from FIGS. 2 to 4 in the shown embodiment, comprises substantially two portions, namely firstly a toggle joint mechanism consisting of the two links 23, 24 with the toggle joint 22 and, secondly, a triangular link 25 pivotable on the fixed axis 17, which link at one of its free triangle corners is connected to the toggle joint mechanism by means of a joint axis 26 and at its second free triangle corner carries a freely rotatable roller 27. The toggle joint mechanism 22, 23, 24, thus, is movable in synchronism to the pivotable link 5, whereby an upwardly directed force on the joint 22 tends to swing the link 25 counter-clockwise around the axis 17 and vice versa.

As mentioned above, however, the lever mechanism operates only conditionally. In the position shown in FIG. 2, the rod 7 (as in FIG. 1) extends vertically above the roller 27, so that the latter stays in rolling contact with the mantle surface of the rod 7. As long as the joint 22 is influenced by an upwardly directed force, the mechanism 13 is thus completely immovable and the joint 22 is to be considered as a point fixed to the machine frame 2. In the following it is assumed that the joint 22 is continuously influenced by a relatively weak, upwardly directed force, e.g. by means of a spring or the like applied in a suitable manner at the bracket plates, so that the total weight of the rod, the operating unit 9 and the lever mechanism 13 is compensated.

If in this position, the cylinder 10 is supplied with compressed air at its upper end portion, the piston rod will start a downwardly directed stroke, whereby the lid 5 and the rod 7 also move downwards. From the upper end position to a position shown in FIG. 3 (quite close to the lower end position shown in FIG. 4), the pneumatic cylinder 10 operates in a conventional manner in that the cylinder is fixed to the joint 22 and the piston rod 12 transmits its movements (without substantial resistance) to the lid 5 and the rod 7. As no significant power transmission is effected at this stage, it does not matter that the operating unit 9 is somewhat oblique relative to the rod 7, as appears from FIG. 2.

In the position shown in FIG. 3 (wherein the lid 5 has reached a position just above the container 4, compare FIGS. 1 and 4), the lever mechanism 13 is put into operation in that the roller 27 rolls over the edge of the upper end portion 28 of the power transmission rod 7, whereby the link 25 rotates counter-clockwise around the axis 17 (under the influence of the upwardly directed force on the joint 22), so that the roller 27 continues to stay in rolling contact with the upper end surface 29 of the rod 7. Now, the lever mechanism 13 is made operative. It is assumed that the lid 5 has now got in touch with the container 4, so that a continued downward movement requires the application of a substantially greater force than before, although the following length of movement is very small.

The joint 22 is no longer a fixed point, but can be moved upwards during a continued counter-clockwise rotation of the link 25, while the roller 27 exerts a vertical force on the rod. Because of the rolling contact, there are no side forces, which is a great advantage. Under a continued application of pressure in the cylinder 10, the operating unit 9 will perform an expanding movement, wherein the piston rod end 12 rests against the lid 5, while the upper end portion of the cylinder 10 pushes the joint 22 upwardly. To begin with, the force exchange is about 1:1 (when the link 24 forms an angle of 45° with the axis of the cylinder), but by the toggle joint action an ever increasing force amplification is achieved during the continued movement. The force reaches a maximum immediately before the end position shown in FIG. 4, where the links 23 and 24 are completely straightened out relative each other. Then the mechanism is also self-locking.

Thus, a multiple force amplification is accomplished during the final stage of the movement. With a proper dimensioning, it is possible to achieve without difficulty a force amplification of about 10 times with the shown embodiment of the lever mechanism. If desired, the mechanism 13 can be constructed in another way known per se in tongs and similar force amplifying devices, in order to achieve the necessary force amplification.

The essential feature of the invention is that one and the same pressurized fluid cylinder can be used in two functions, namely actng directly in the first stage of the movement (FIG.2) as well as under force amplification by means of the lever mechanism 13 (FIGS. 3, 4). This double function is primarily enabled by the link 25 with the roller 27 serving as a follower device and sensing the passage of the upper end portion 28 of the rod 7, whereby the lever mechansim is put into operation. It is not necessary that the roller 27 senses exactly the end surface 29. The upper end portion 28 of the rod can e.g. be provided with a central recess or a slit, into which the roller 27 runs when the slit reaches a position opposite the same. Whether the roller senses the end surface, a slit or some other means on the rod 7, a suitable cam or run surface could be formed for a desired force amplification characteristic. The force amplification characteristic can also be varied by axial (vertical) adjustment of the lid on the lower end portion of the rod 7, e.g. so that the maximum force (corresponding to straightened out links 23, 24) is never achieved but only a desired highest value of the force.

The device according to the invention can be applied in several ways. Apart from machine tools and units for tightness testing, as mentioned above, the following fields of application are feasable:

door or gate closers, particularly on vehicles and ships;

actuating devices in industrial processes;

jacks (if a maximum force is required for only a minor part of the movement).

What is denoted "frame" in the above description and in the claims can consist of a body of any kind, a frame, a support or a bed, relative to which the object is to be displaced. Also, the displacement direction could be oriented as desired.

The operating unit 9 does not necessarily consist of a pressurized fluid cylinder but could be any kind of linearly operating motor device, e.g. an electrical linear motor, a conventional rotating electrical motor with a screw-nut-transmission, etc.

I claim:

1. A device for displacement of an object along a predetermined distance relative to a frame or the like, wherein a first, longer part of the displacement requires a relatively minor force, while another, shorter part of the displacement requires a substantially greater force; said device comprising: an operating unit connected to the object, a power transmission rod linearly guided relative to the frame and displaceable along said predetermined distance and having a first end portion in power transmitting contact with the object and a second end portion, a lever mechanism operable between said frame and said power transmission rod, said operating unit being arranged substantially in parallel to said power transmission rod and having a first end connected to said first end portion of the power transmission rod and a second end connected to the second end portion of the transmission rod via said lever mechanism in such a way that said lever mechanism is non-operative during the first part of the displacement, in which said operating unit acts directly between said frame and said first end portion of the power transmission rod, and in such a way that said lever mechanism by means of a mechanical follower device becomes operative by sensing said second end portion of said power transmission rod, so that during the second part of the displacement said operating unit acts between said first end portion of said power transmission rod and said lever mechanism under a multiple amplification of the force generated by said operating unit, in which second part the amplified force acts on said second end portion of said power transmission rod.

2. A device according to claim 1, wherein said follower device comprises a link pivotally mounted on the frame and forming part of said lever mechanism, said link having a free end portion touching a mantle surface of the power transmission rod in said non-operative position, whereas, in said operative position said free end portion of said link touches an end surface of said power transmission rod at said second end portion.

3. A device according to claim 2, wherein said free end portion of said link is provided with a freely rotatable roller.

4. A device according to claim 1, wherein said operating unit is pivoted during the first part of the displacement but is substantially parallel to said power transmission rod during the second, force amplifying part of the displacement.

5. A device according to any one of claims 1 to 4, wherein said object is axially adjustably connected to said first end portion of the power transmission rod.

6. A device according to any one of claims 1 to 4, wherein said lever mechanism comprises a toggle joint mechanism.

7. A device according to claim 6, wherein said toggle joint mechanism has a toggle joint, and wherein said second end of said operating unit is connectd to said toggle joint.

8. A device according to claim 7, wherein said toggle joint mechanism is self-locking at the end of the second part of the displacement.

* * * * *